US008508560B2

(12) United States Patent
Adachi

(10) Patent No.: US 8,508,560 B2
(45) Date of Patent: Aug. 13, 2013

(54) LIQUID CRYSTAL DISPLAYING DEVICE AND METHOD

(75) Inventor: Takeshi Adachi, Saitama (JP)

(73) Assignees: Mitsumi Electric Co., Ltd., Tokyo (JP); ATRC Corporation, Saitama (JP)

( * ) Notice: Subject to any disclaimer, the term of this patent is extended or adjusted under 35 U.S.C. 154(b) by 313 days.

(21) Appl. No.: 12/959,425

(22) Filed: Dec. 3, 2010

(65) Prior Publication Data

US 2011/0134159 A1 Jun. 9, 2011

(30) Foreign Application Priority Data

Dec. 4, 2009 (JP) ..... 2009-276134

(51) Int. Cl.
*G09G 3/36* (2006.01)
*G09G 5/10* (2006.01)

(52) U.S. Cl.
USPC ..... 345/690; 345/102; 345/87; 345/89; 345/98

(58) Field of Classification Search
USPC ..... 345/102; 362/97.1, 97.2
See application file for complete search history.

(56) References Cited

U.S. PATENT DOCUMENTS

2003/0201968 A1* 10/2003 Itoh et al. ..... 345/102
2004/0028271 A1* 2/2004 Pollard et al. ..... 382/162
2005/0057486 A1* 3/2005 Aoki et al. ..... 345/102
2006/0103621 A1* 5/2006 Feng ..... 345/102
2006/0238487 A1* 10/2006 Shih ..... 345/102
2006/0262078 A1* 11/2006 Inuzuka et al. ..... 345/102
2007/0216311 A1* 9/2007 Cernasov et al. ..... 315/3
2008/0007512 A1 1/2008 Honbo
2009/0322737 A1* 12/2009 Kim et al. ..... 345/215
2010/0007599 A1* 1/2010 Kerofsky ..... 345/102
2010/0110300 A1* 5/2010 Ueno et al. ..... 348/625
2011/0025725 A1* 2/2011 Hulze ..... 345/690
2011/0193870 A1* 8/2011 Kerofsky ..... 345/589

FOREIGN PATENT DOCUMENTS

JP 2008-015430 1/2008

* cited by examiner

*Primary Examiner* — Alexander S Beck
*Assistant Examiner* — Christian R Ruiz
(74) *Attorney, Agent, or Firm* — IPUSA, PLLC

(57) ABSTRACT

A disclosed liquid crystal displaying device having a liquid crystal displaying unit and a backlight unit includes a signal processing unit dividing an input signal into plural blocks in conformity with a predetermined number of dividing a screen of the backlight unit, a high frequency component acquiring unit acquiring high frequency components for the blocks; a signal component analyzing unit analyzing signal components of the input signal for the blocks, a low frequency component acquiring unit acquiring low frequency components for the blocks, a backlight driving signal generating unit generating a backlight driving signal based on signals acquired by the signal component analyzing unit and the low frequency component acquiring unit, an inverter inverting the backlight driving signal, and a synthesizing unit acquiring a synthesized signal displayed by the liquid crystal displaying unit based on the input signal, the high frequency components, and the inverted driving signal.

8 Claims, 7 Drawing Sheets

FIG.6

| | Backlight (LINE(I)) | Signal LPF (LINE(D)) | Signal HPF (LINE(B)) |
|---|---|---|---|
| Aa Block | Max 100% | Min (or 0%) | Min (or 0%) |
| Bb Block | 20% | Add | Add |
| Cc Block | Min 0% | Min (or 0%) | Min (or 0%) |

LIQUID CRYSTAL DISPLAYING DEVICE AND METHOD

CROSS-REFERENCE TO RELATED APPLICATIONS

This patent application is based upon and claims the benefit of priority of Japanese Patent Application No. 2009-276134 filed on Dec. 4, 2009 the entire contents of which are incorporated herein by reference.

BACKGROUND OF THE INVENTION

1. Field of the Invention

The present invention generally relates to a liquid crystal displaying device and a liquid crystal displaying method. More specifically, the present invention relates to a liquid crystal displaying device and a liquid crystal displaying method which can effectively reduce power consumption and realize an optimum image quality.

2. Description of the Related Art

Techniques of high definition and high image quality in liquid crystal displaying devices or the like are rapidly developing along with a rapid increment of demands for the liquid crystal displaying devices or the like. Light sources of backlights employed in displaying on the liquid crystal displaying devices or the like are changing from Cold Cathode Fluorescent Lamps (CCFL) to Light Emitting Diodes (LED) and may be replaced within several years because the Cold Cathode Fluorescent Lamps (CCFL) have ecological problems such as a use of mercury and consumption power, and problems of image qualities such as contrast and color reproduction.

The LED backlights are employed in various technical fields such as portable phones, notebook computers, and small-sized monitors. Companies are planning to employ the LED backlights for middle to large-sized television sets and displays in future.

A schematic configuration of an example liquid crystal displaying device is described in reference to FIGS. 1A and 1B. FIGS. 1A and 1B illustrate the schematic configuration of the example liquid crystal displaying device. FIG. 1A illustrates an example liquid crystal displaying device using an example CCFL backlight. FIG. 1B illustrates an example liquid crystal displaying device using an example LED backlight.

The liquid crystal displaying device 10-1 illustrated in FIG. 1A includes a signal processing unit 11, a picture quality adjusting unit 12, a liquid crystal panel 13 as a liquid crystal displaying unit, a power source unit 14, and a CCFL back light unit 15. The liquid crystal displaying device 10-2 illustrated in FIG. 1B includes a signal processing unit 11, a picture quality adjusting unit 12, a liquid crystal panel 13, and a LED driver 16 and a LED backlight unit 17.

The liquid crystal displaying device 10-1 illustrated in FIG. 1A is provided to control brightness of a light source of the backlight. The image quality may be mainly improved using a single control system for a signal system. Specifically, when the liquid crystal displaying device 10-1 receives an image signal transmitted from, for example, a provider such as a broadcast station, the signal processing unit 11 carries out signal processing to enable an image contained in the image signal to be displayed on the liquid crystal panel 13.

The picture quality adjusting unit 12 adjusts the liquid crystal displaying device 10-2 to improve the image quality acquired by the signal processing unit 11 using predetermined conditions such as brightness, contrast, black balance and white balance.

The power source unit 14 supplies a predetermined amount of the power to the CCFL back light unit 15. In the CCFL backlight unit 15, lights emitted from the cathode tube as the light source repeatedly reflect on end surfaces of a light guide plate. Thus, the backlight is adjusted to be evenly luminous on the entire surface of the CCFL backlight unit 15.

The liquid crystal displaying device 10-1 makes visible an image signal included in an input signal by irradiating the surface of the liquid crystal panel 13 with the back light generated by the CCFL backlight unit 15.

The liquid crystal displaying device 10-2 illustrated in FIG. 1B is a LED backlight system provided to control the brightness of the backlight light source. In the liquid crystal displaying device 10-2 illustrated in FIG. 1B, the signal processing unit 11, the picture quality adjusting unit 12, and the liquid crystal panel 13 have functions substantially similar to the above liquid crystal displaying device 10-1. Therefore, descriptions of these same portions are omitted.

In a case where the backlight using LEDs is provided, groups of LEDs having colors of red (R), green (G) and blue(B) are arranged at predetermined positions, and the liquid crystal panel 13 is irradiated with the backlight generated by the groups of LEDs to thereby make visible the image signal.

Specifically, the picture quality adjusting unit 12 outputs information of the image signal to be made visible on the liquid crystal panel 13 to the LED driver 16. The LED driver causes the LEDs to emit light from a part of the LEDs at corresponding positions of the liquid crystal panel 13 on which the image signal is applied. Thus, the backlight of the liquid crystal panel 13 is realized.

For example, there is proposed a liquid crystal displaying device which improves an image quality of movies using a LED backlight (for example, Patent Document 1).

However, the above described CCFL backlight system tries to improve the image quality only with the single backlight source. Therefore, when the image signal does not conform to light distribution of the backlight, a blackout, a whiteout or the like may occur. In this case, there is a problem that an anticipated improvement is not obtainable. Further, the consumption power of the CCFL backlight system is larger than that of the LED backlight system.

Further, there is a regional brightness controlling technique (local dimming) using a top type backlight which is controlled relative to plural portions of a divided display screen in the above LED backlight system. In this local dimming, a change of the brightness in the vicinity of the divided boundary and the components of the image signal may overlap with a time interval. In this case, an unnatural display occurs and the image quality is degraded.

Patent Document 1: Japanese Laid-Open Patent Application No. 2008-15430

SUMMARY OF THE INVENTION

Accordingly, embodiments of the present invention may provide a novel and useful liquid crystal displaying device and liquid crystal displaying method solving one or more of the problems discussed above. More specifically, the embodiments of the present invention may provide a liquid crystal displaying device and liquid crystal displaying method with which an effective reduction of the consumption power and an optimum image are simultaneously obtainable.

A first aspect of the present invention may be to provide a liquid crystal displaying device having a liquid crystal displaying unit and a backlight unit for emitting a light into a back surface of the liquid crystal displaying unit, the liquid crystal displaying device including: a signal processing unit configured to divide an input signal into a plurality of blocks in conformity with a predetermined number of dividing a screen of the backlight unit; a high frequency component acquiring unit configured to acquire high frequency components for each of the plurality of blocks; a signal component analyzing unit configured to analyze signal components of the input signal for each of the plurality of blocks; a low frequency component acquiring unit configured to acquire low frequency components for each of the plurality of blocks; a backlight driving signal generating unit configured to generate a backlight driving signal for the backlight unit based on signals acquired by the signal component analyzing unit and the low frequency component acquiring unit; an inverter configured to invert the backlight driving signal acquired by the backlight driving signal generating unit; and a synthesizing unit configured to acquire a synthesized signal displayed by the liquid crystal displaying unit based on the input signal, the high frequency components acquired by the high frequency component acquiring unit, and an inverted driving signal acquired by the inverter.

With the first aspect, it is possible to simultaneously realize an efficient reduction of power consumption and an optimum image quality.

A second aspect of the present invention may be to provide the liquid crystal displaying device according to the preceding aspect, wherein the low frequency component acquiring unit includes a first level adjusting unit configured to adjust an acquired frequency level.

With the second aspect, the properties of the low pass filter can be gradually changed in response to the number of arbitrarily dividing the backlight to thereby simultaneously realize the effective reduction of the power consumption and the optimum image quality.

A third aspect of the present invention may be to provide the liquid crystal displaying device according to the preceding aspect, wherein the inverter includes a second level adjusting unit configured to adjust an inverting level of the backlight driving signal.

With the third aspect, it is possible to optimally correct artificiality caused by a change of brightness under a brightness control for regions by adjusting the inverted driving signal acquired by the inverting process.

A fourth aspect of the present invention may be to provide the liquid crystal displaying device according to the preceding aspect, wherein the signal component analyzing unit detects the signal components of the input signal on the screen in its entirety, and the backlight driving signal generating unit generates the backlight driving signal of the backlight unit using a control signal acquired by synthesizing a reference voltage corresponding to the signal component detected by the signal component analyzing unit with the low frequency components acquired by the low frequency component acquiring unit.

With the fourth aspect, it is possible to realize the optimum image control by controlling the backlight driving signal of the backlight based on the signal components of the input signal such as an image and the low frequency components.

A fifth aspect of the present invention may be to provide the liquid crystal displaying device according to the preceding aspect, wherein the synthesizing unit synthesizes the inverted driving signal with the high frequency components to provide a correction signal for the backlight.

With the fifth aspect, it is possible to realize an optimum image quality control by generating the correction signal using the inverted backlight driving signal and the high frequency components of the input signal such as an image.

A sixth aspect of the present invention may be to provide the liquid crystal displaying device according to the preceding aspect, wherein the synthesizing unit causes the correction signal to be associated with the backlight driving signal, controlled to match levels of the correction signal and the driving signal, and superposed on the input signal.

With the sixth aspect, it is possible to realize an optimum image quality control by associating the backlight with the input signal such as an image.

A seventh aspect of the present invention may be to provide a liquid crystal displaying method used in a liquid crystal displaying device having a liquid crystal displaying unit and a backlight unit for emitting a light into a back surface of the liquid crystal displaying unit including dividing an input signal into a plurality of blocks in conformity with a predetermined number of dividing a screen of the backlight unit; acquiring high frequency components for each of the plurality of blocks; analyzing signal components of the input signal for each of the plurality of blocks; acquiring low frequency components for each of the plurality of blocks; generating a backlight driving signal for the backlight unit based on signals acquired by the analyzing the signal components and the acquiring the low frequency components; inverting the backlight driving signal acquired by the generating the backlight driving signal; and acquiring a synthesized signal displayed by the liquid crystal displaying unit based on the input signal, the high frequency components acquired by the acquiring of the high frequency components, and an inverted driving signal acquired by the inverting of the backlight driving signal.

With the seventh aspect, it is possible to simultaneously realize an efficient reduction of power consumption and an optimum image quality.

An eighth aspect of the present invention may be to provide the liquid crystal displaying method according to the preceding aspect wherein the acquiring of low frequency components includes adjusting a first level for adjusting an acquired frequency level.

With the eighth aspect, the properties of the low pass filter can be gradually changed in response to the number of arbitrary divisions of the backlight to thereby simultaneously realize the effective reduction of the power consumption and the optimum image quality.

A ninth aspect of the present invention may be to provide the liquid crystal displaying method according to the preceding aspect, wherein the inverting of the backlight driving signal includes adjusting a second level for adjusting an inverting level of the backlight driving signal.

With the ninth aspect, it is possible to optimally correct artificiality caused by a change of brightness under a brightness control for regions by adjusting the inverted driving signal acquired by the inverting process.

A tenth aspect of the present invention may be to provide the liquid crystal displaying method according to the preceding aspect, wherein the analyzing of signal components includes detecting the signal components of the input signal on the screen in its entirety, and the generating backlight driving signal includes generating the backlight driving signal of the backlight unit using a control signal acquired by synthesizing a reference voltage corresponding to the signal component detected by the analyzing the signal component with the low frequency components acquired by the acquiring of the low frequency components.

With the tenth aspect, it is possible to realize the optimum image control by controlling the backlight driving signal of the backlight based on the signal components of the input signal such as an image and the low frequency components.

An eleventh aspect of the present invention may be to provide the liquid crystal displaying method according to the preceding aspect, wherein the acquiring the synthesized signal synthesizes the inverted driving signal with the high frequency components to provide a correction signal for the backlight.

With the eleventh aspect, it is possible to realize an optimum image quality control by generating the correction signal using the inverted backlight driving signal and the high frequency components of the input signal such as an image.

A twelfth aspect of the present invention may be to provide the liquid crystal displaying method according to the preceding aspect, wherein the acquiring of the synthesized signal includes causing the correction signal to be associated with the backlight driving signal, to be controlled to match levels of the correction signal and the driving signal, and to be superposed on the input signal.

With the twelfth aspect, it is possible to simultaneously realize an efficient reduction of power consumption and an optimum image quality.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

BRIEF DESCRIPTION OF THE DRAWINGS

FIG. 6 illustrates an example operational condition of a LED backlight of the embodiment.

DETAILED DESCRIPTION OF THE PREFERRED EMBODIMENTS

A description is given below, with reference to the FIG. 2 through FIG. 6 of an embodiment of the present invention. Reference symbols typically designate as follows:

10: Liquid crystal displaying device;
11, 21: Signal processing unit;
12: Picture quality adjusting unit;
13: liquid crystal panel (liquid crystal displaying unit)
14: Power source unit;
15: CCFL back light unit;
16: LED driver;
17, 30: LED backlight unit;
20: Liquid crystal displaying device;
22: High pass filter (HPF);
23: Signal component analyzing unit;
24: Low pass filter (LPF);
25: First level adjusting unit;
26: LED driver;
27: Inverter;
28: Second level adjusting unit;
29: Synthesizing unit; and
31: Liquid crystal panel.

The embodiment provides a technique of improving an image quality of a liquid crystal displaying device used in a Liquid Crystal Display (LCD)-TV receiver. The embodiment provides a backlight controlling method of a type of brightness control for regions (Local Dimming) which method carries out an optimum image quality control by controlling the back light while associating a signal information for a back light with an input picture or movie image signal in the liquid crystal displaying device in which a backlight block is divided into an arbitrary number of blocks and the signal information for the back light is obtained by applying a high pass filter and a low pass filter to the input picture or movie image signal.

Further, in controlling the backlight as above, a property of the low pass filter may be gradually changed and processed in response to the arbitrarily divided number of the screen. With this, a method of controlling the liquid crystal display while simultaneously enabling effective reduction of the consumption power and optimum image quality is provided.

Hereinafter, a preferred embodiment of a liquid crystal displaying device and liquid crystal displaying method is described in reference to the figures.

<The Functional Configuration and Example Operations of the Liquid Crystal Displaying Device>

The functional configuration and example operations of the liquid crystal displaying device of the embodiment are described in reference to figures. A backlight mechanism using a LED is described. However, the present invention is not limited thereto and may be a backlight using another luminous element or the like.

Figure 1A:
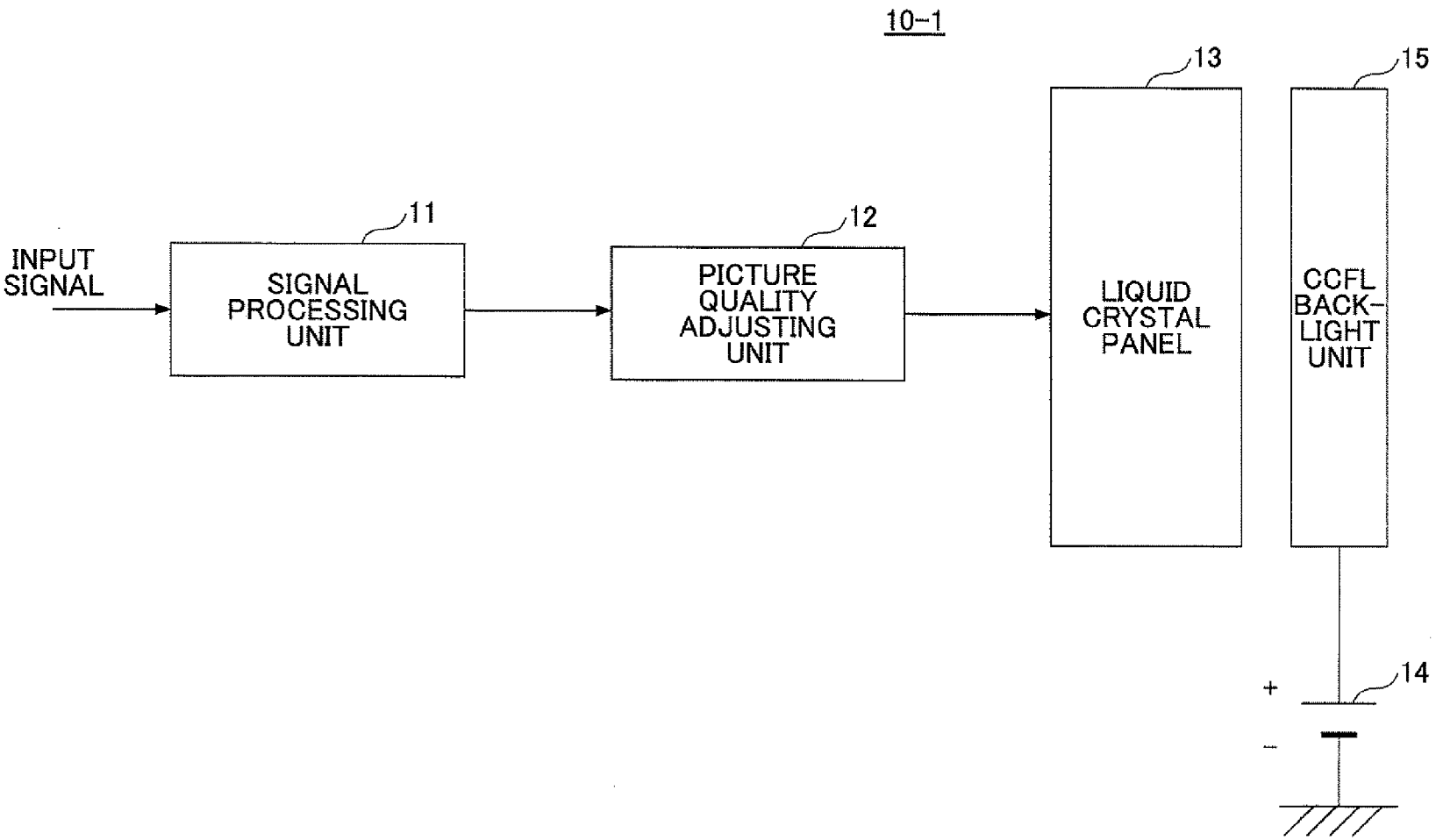
FIG.1A RELATED ART
FIG. 1A and FIG. 1B illustrate a schematic configuration of an example liquid crystal displaying device.
Figure 1B:
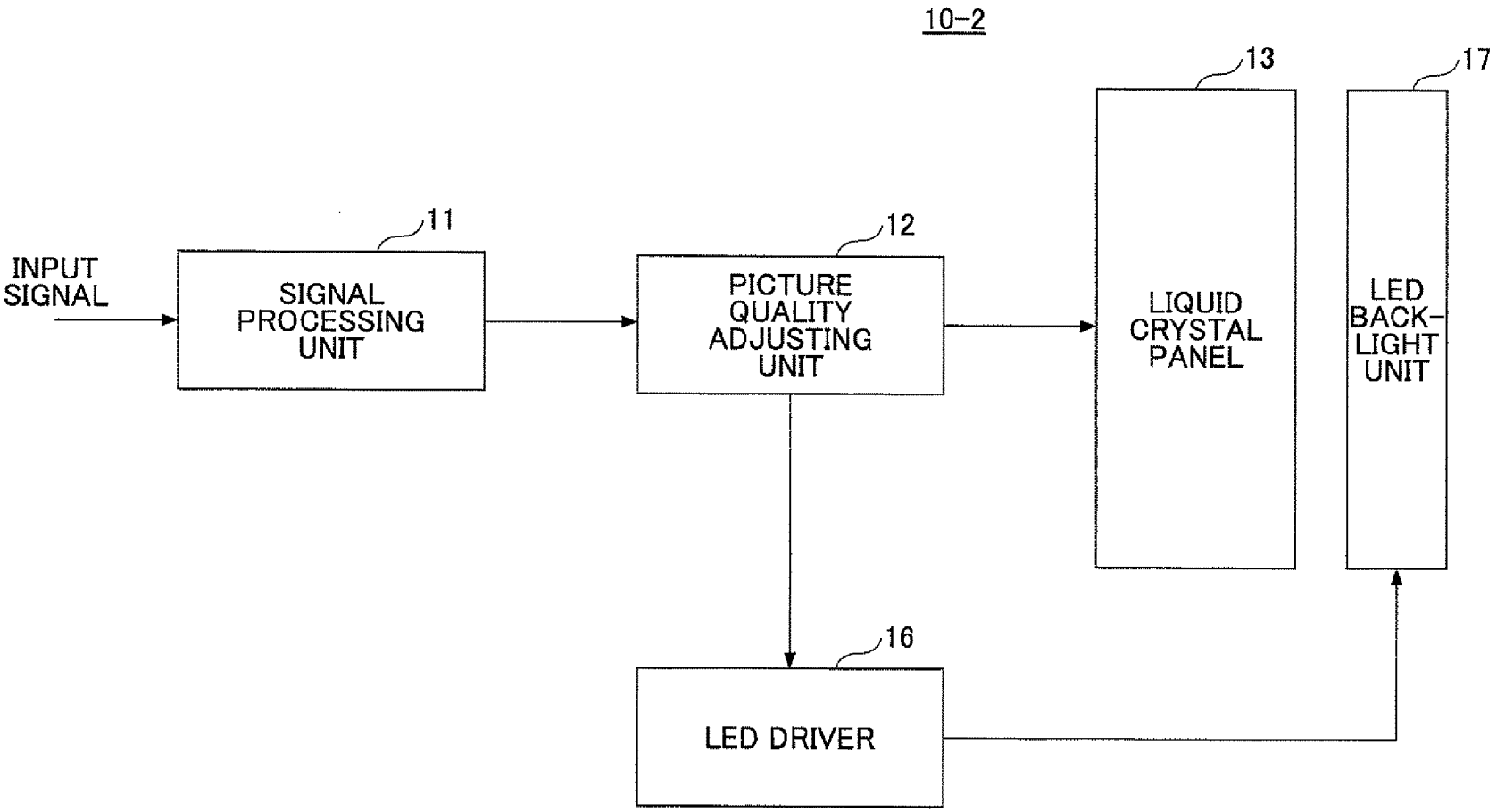
FIG.1B RELATED ART
Figure 2:
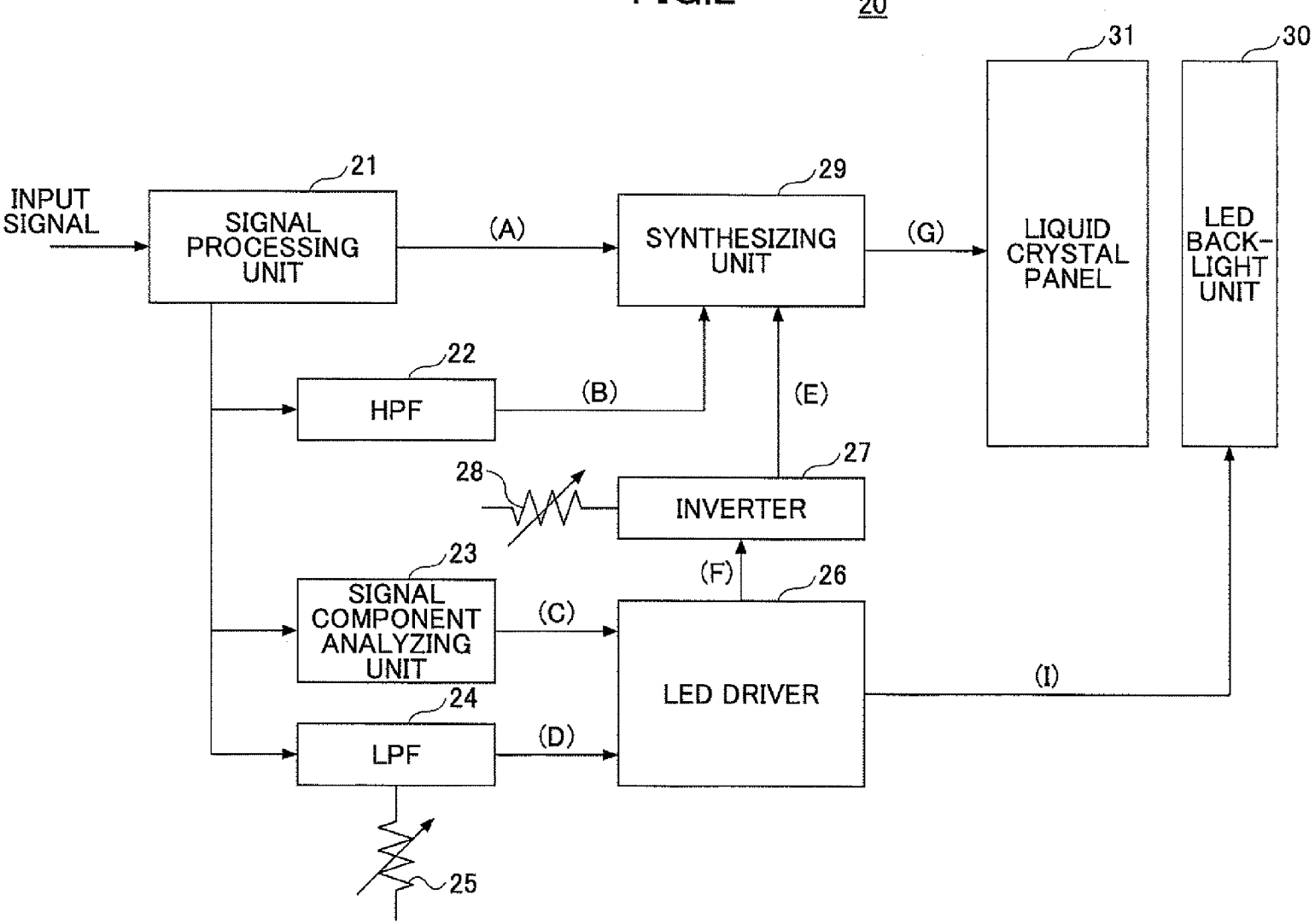
FIG. 2 illustrates a functional configuration of an example liquid crystal displaying device of an embodiment.
Figure 3:
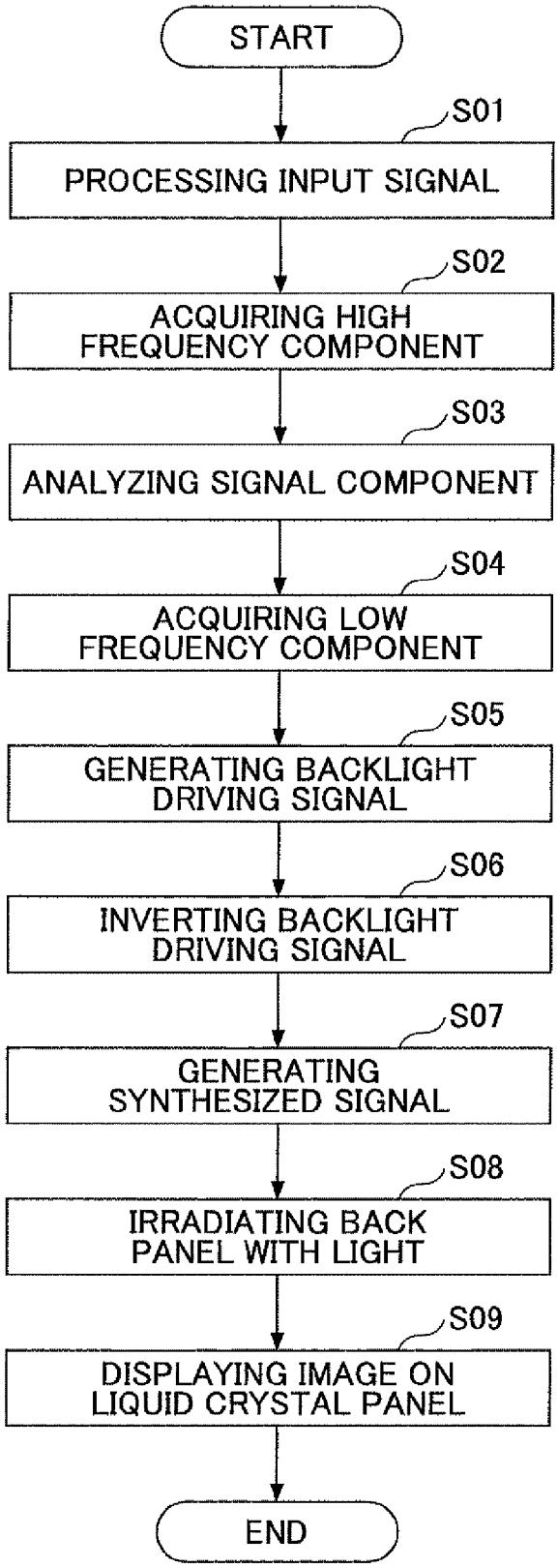
FIG. 3 is a flowchart illustrating a brightness control for regions in the embodiment.
Figure 4:
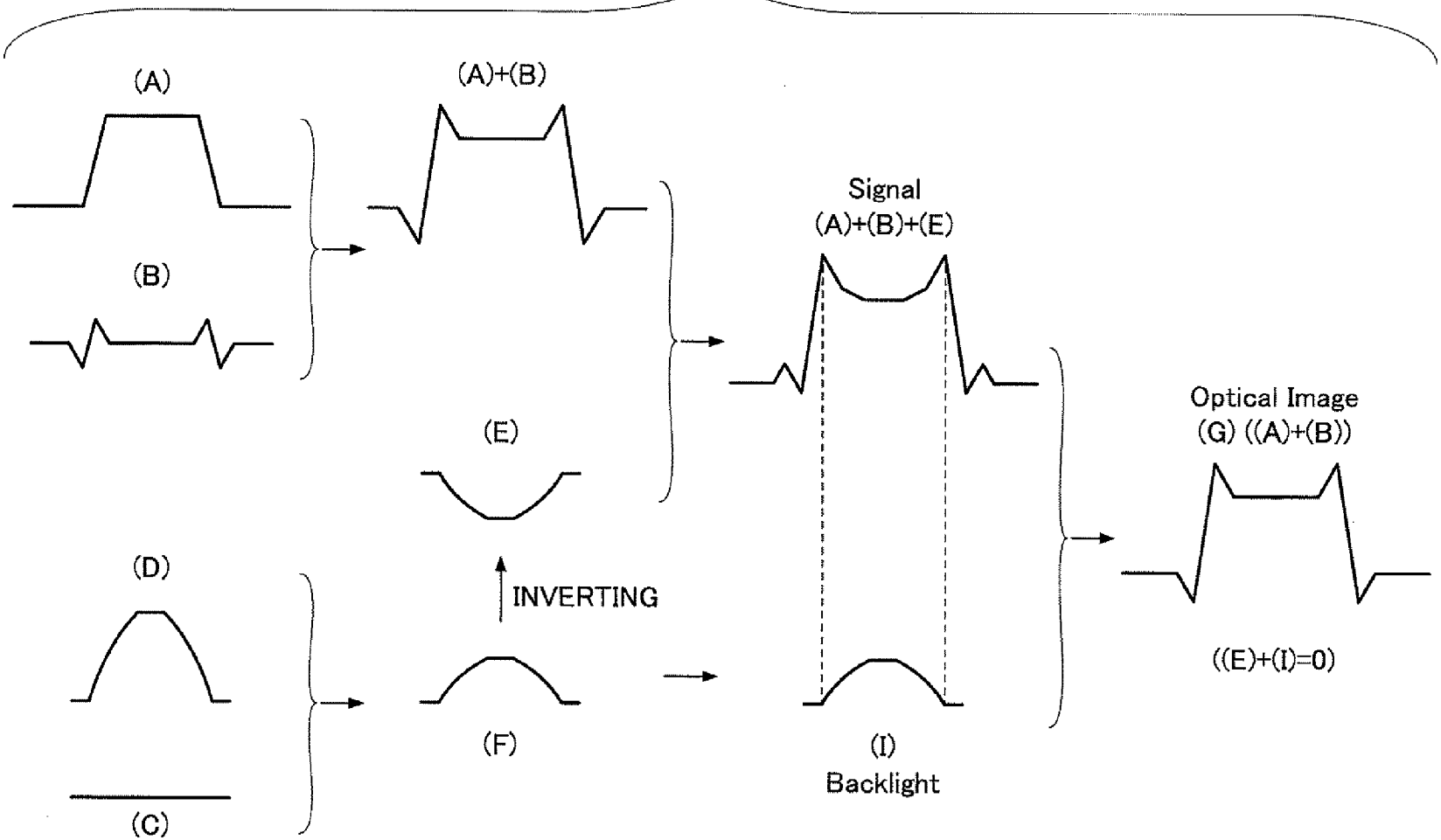
FIG. 4 illustrates example signal waveforms of the embodiment.

FIG. 2 illustrates a functional configuration of an example liquid crystal displaying device of the embodiment. FIG. 4 is a flowchart illustrating a brightness control for regions in the embodiment. Reference symbols (A) to (G) correspond to lines in FIG. 2. FIG. 3 illustrates signal waveforms in the lines (A) to (G), and descriptions of the signal waveforms are described later.

The liquid crystal displaying device 20 includes a signal processing unit 21, a high pass filter 22 for acquiring high frequency components, a signal component analyzing unit 23, a low pass filter 24 for acquiring low frequency components, a first level adjusting unit 25, a LED driver 26 as a LED driving signal generating unit, an inverter 27, a second level adjusting unit 28, a synthesizing unit 29, a LED backlight unit 30, and a liquid crystal panel 31 as a liquid crystal displaying unit.

In the liquid crystal displaying device 20 illustrated in FIG. 2, when the input signal is input in the signal processing unit 21, the signal processing unit 21 carries out signal processing of generating an image signal in which image data are continuously arranged in conformity with, for example, the number of pixels of the liquid crystal panel 31 so as to enable display of the movie or picture image contained in the input signal in step S01.

In step S01, the signal processing unit 21 divides a screen relative to the input signal based on a predetermined condition. The predetermined condition is to segment into the number of divided blocks of the LED backlight unit 30 in order to carry out the brightness control for regions of the embodiment. The user may arbitrarily set the predetermined condition. The predetermined condition may be arbitrarily set in response to contents of the input signal, the image size, an accuracy of image quality to be displayed, and performance (a processing time or the like). The signal processing unit 21 transmits the processed image signal to the signal component analyzing unit 23, the LPF 24, and the synthesizing unit 29.

The HPF 22 filters the image signal received from the signal processing unit 21 using predetermined frequencies for each divided block to thereby acquire high frequency components in step S02. The HPF 22 outputs the acquired high frequency components (high level correction signal (B)) to the synthesizing unit 29. The high frequency components acquired by the HPF 22 are superposed on the original signal in order to prevent image degradation from occurring between the divided blocks of the back light when the brightness control for regions is carried out.

The signal component analyzing unit 23 analyzes the contents of the signal components of the input image signal from the signal processing unit 21 in step S03. Specifically, the signal component analyzing unit 23 can analyze at least one of an average brightness (APL), various information items related to the average brightness such as a voltage, a brightness distribution such as a brightness histogram, a color distribution such as a color histogram, a frequency component distribution such as a frequency histogram, a black level (a brightness level of 10% or less), and a white level (a brightness level of 90% or more).

The signal component analyzing unit 23 may extract brightness and color information for each pixel in association with the resolution of the input signal, and analyze brightness distribution, contrast information, color reproduction information, frequency component information, or the like using brightness histogram distribution property data, chromaticity histogram distribution data, color histogram distribution data, or frequency histogram distribution data. With this, the LED driver 26 provided in a latter stage can generate a backlight drive signal which realizes an optimum image quality control using the brightness and chromat city information being signal components of the input image signal.

With the embodiment, it is possible to previously set a lookup table (LUT) which defines plural histogram distribution data patterns and image quality control information and a backlight driving signal respectively corresponding to the plural histogram distribution data patterns in conjunction with the brightness histogram distribution property data, the chromaticity histogram distribution data, the color histogram distribution data, and the frequency histogram distribution data. In this case, the signal component analyzing unit 23 may dynamically and efficiently acquire various information items by associating the extracted histogram distribution data with anyone of the histogram distribution data patterns of the above-mentioned LUTs.

The signal component analyzing unit 23 may analyze the signal components among the divided blocks divided by the signal processing unit 21 based on a predetermined condition, or may analyze the signal components of the input signal for the entire screen based on a predetermined condition.

The signal component analyzing unit 23 outputs the contents of the components (C) such as a voltage corresponding to an average brightness as a result of the analysis to the LED driver 26.

The LPF 24 filters the image signal received from the signal processing unit 21 using predetermined frequencies for each divided block to thereby acquire low frequency components in step S04. The predetermined frequencies used by the LPF 24 may be changed by the first level adjusting unit 25.

The properties of low pass filter of the LPF 24 can be gradually changed with the first level adjusting unit 25 in response to the number of the arbitrarily divided LED backlight. For example, the LPF 24 adjusts the frequency to be fL=15 KHz×(4/2)=30 KHz when the LED backlight is divided into 12 blocks (a length of 3 blocks by a width of 4 blocks) or fL=15 KHz×(80/2)=600 KHz when the LED backlight is divided into 4800 blocks (a length of 60 blocks by a width of 80 blocks). As described, it is possible to obtain the desired frequency in response to the number of divided backlight blocks to thereby more efficiently realize a display having optimum image quality.

Referring to FIG. 2, a variable resistance is exemplified as the first level adjusting unit 25. However, the present invention is not limited to this and may have a structure by which the frequency level to be filtered is adjusted. The LPF 24 outputs the low frequency signal (lower range correcting signal (D)) obtained by filtering the image signal to the LED driver 26.

The LED driver 26 generates a LED driver signal (backlight driving signal (I)) to directly drive LEDs arranged on the LED backlight unit 30 to cause the LEDs to emit lights of red (r), green (g) and blue (b) colors with the control signal obtained by synthesizing a reference voltage corresponding to the signal component of the entire screen such as an average brightness generated by the signal component analyzing unit 23 and the low frequency components acquired by the LPF 24 in step S05.

The inverter 27 controls the signal levels of the LED driver signal generated by the LED driver 26 in conformity with level information set up by a second level adjusting unit 28. The inverter 27 causes a part or all of the low frequency components which control the LED backlight to be inverted based on the condition such as predetermined level adjustments in step S06 to thereby generate an inverted driving signal. Referring to FIG. 2, a variable resistance is exemplified as the second level adjusting unit 28. However, the present invention is not limited to this and may have a structure by which a level of inverting the signal is adjusted. The low frequency components (inverted driving signal (E)) generated by the inverter 27 can correct artificiality of a brightness change in the brightness control for regions.

The synthesizing unit 29 generates a synthesized signal (G) by superposing the high frequency components acquired by the HPF 22 and the inverted driving signal (E) generated by the inverter 27 on the image signal processed by the signal processing unit 21 in step S07. The synthesizing unit 29 outputs the synthesized signal (G) by superposing image information related to the backlight on image information related to the image signal as described above to the liquid crystal panel 31.

The synthesizing unit 29 generates the correcting signal of the LED backlight unit 30 by synthesizing the inverted driving signal and the high frequency components. The synthesizing unit 29 controls the level of the correcting signal in association with the driving signal of the LED backlight unit 30 and superposes the controlled correcting signal on the input signal to thereby generate the panel driving signal to have an effect on the liquid crystal panel 30.

Said differently, the high frequency signal (B) passing through the HPF 22 and the inverted signal (E) of the backlight signal (F) output from the LED driver 26 are synthesized with an original signal (A) to drive the liquid crystal panel 31.

The LED backlight unit 30 drives the arranged LEDs to cause the arranged LEDs to emit lights with the LED driving signal generated by the LED driver 26 to irradiate the back panel with the emitted light in step S08. The back side of the liquid crystal panel 31 is irradiated by the emitted light as the back light to thereby display an image on the liquid crystal panel 31 in step S09.

The liquid crystal panel 31 receives the image information related to the backlight and the image information related to the image signal from the synthesizing unit 29 and displays the image corresponding to the input signal by driving the liquid crystal panel 31.

As described, the input image signal is separated into the low frequency components and the high frequency components, and the amount of the low frequency components is controlled to be optimum for the control of the LED backlight. Further, a part of the low frequency components which controls the LED backlight is inverted by the inverter to synthesize with the above high frequency components to compensate by stressing the high frequency range so that the synthesized signal is added as the backlight correcting signal to the original image signal (A) to control the backlight.

In the embodiment, the above low frequency components are used mainly to control the backlight. When the control level of the backlight is excessively large, the backlight correcting signal is operated to correct the artificiality of the brightness change at a time of the brightness control for regions (Local Dimming) as the lower range correcting signal. The above high frequency components may be superposed on the original signal (original image signal (A)) for correcting the image quality as the high range correcting signal. The high range correcting signal (B) makes it possible to prevent the degradation of the image quality occurring among the backlight blocks under the brightness control for the regions.

<Signal Waveform>

Next, signal waveforms in lines (A) to (G) of FIG. 2 are described. FIG. 4 illustrates example signal waveforms of the embodiment. The signal waveform of the line (A) illustrated in FIG. 4 is the original image signal (A) for driving the liquid crystal panel which is generated by the signal processing unit 21 from the input signal. The signal waveform of the line (B) illustrated in FIG. 4 is the high range correcting signal which is acquired based on the image signal and acquired through the HPF 22. The line (C) of FIG. 2 is the reference voltage acquired by the signal component analyzing unit 23 by detecting the average brightness correcting voltage from the image signal processed by the signal processing unit 21.

The signal waveform of the line (D) illustrated in FIG. 4 is the low range correcting signal which is acquired based on the image signal and acquired through the LPF 24. The signal waveform of the line (E) is the backlight correcting signal acquired by inverting with the inverter 27 the backlight driving signal (F) generated from the reference voltage of the line (C) and the lower range correcting signal of the line (D).

The above backlight driving signal (F), (I) is provided to drive an impulse type backlight such as the LED backlight by superposing the signal (D) from the LPF 24 for detecting the low frequency components on the reference voltage (C) detected by the signal component analyzing unit 23 using the original image signal (A) processed by the signal processing unit 21.

The signal waveform of a line (F) is the backlight driving signal generated by the reference voltage of the line (C) illustrated in FIG. 2 and the lower range correcting signal of the line (D) illustrated in FIG. 2.

Further, the signal waveform (Optical Image) of FIG. 4 includes the image information related to the image signal (G) acquired by synthesizing the signal waveforms (Signal) of the lines (A), (B) and (E) and the image information related to the backlight acquired from the backlight driving signal of the line (I) of FIG. 2 having the waveform the same as (F) of FIG. 4.

Said differently, referring to FIG. 4, the displayed image (Optical Image) is acquired by applying the Signal (G) obtained by superposing the high frequency edge signal (B) acquired by the HPF 22 from the input signal and the inverted backlight signal (E) generated by inverting the LED backlight driving signal (F) on the original image signal (A) for displaying on the liquid crystal panel 31 and further applying the Backlight (I) being the LED backlight driving signal (F) to the LED backlight unit 30. As described, it is possible to correct the artificiality of the brightness change at the time of the brightness control for the regions using the above various signals to thereby make it possible to realize the optimum image quality.

<Example Operations of the Backlight in Displaying the Liquid Crystal Panel of the Embodiment>

Figure 5:
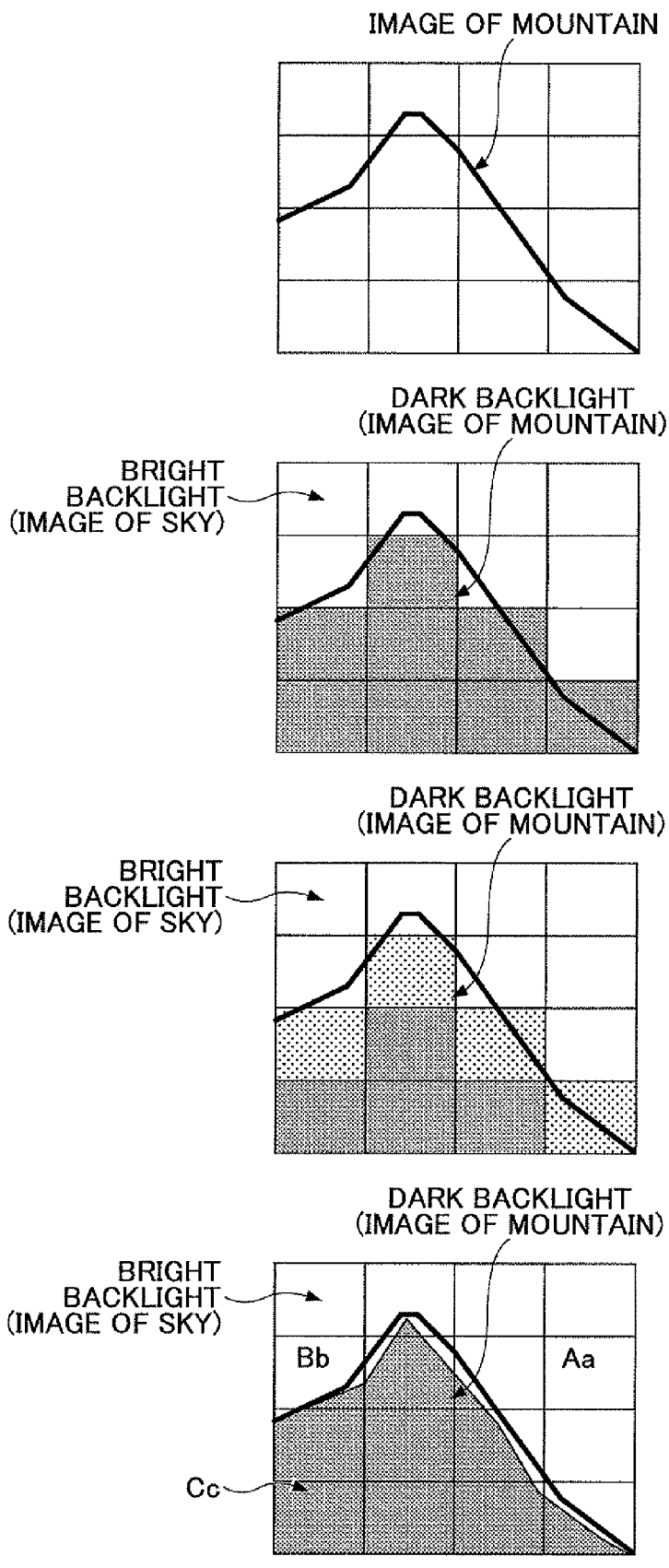
FIG. 5 illustrates example operations of a backlight for a liquid crystal panel of the embodiment.

Next, example operations of the backlight in displaying the liquid crystal panel of the embodiment is described. FIG. 5 illustrates operations of a backlight for the liquid crystal panel of the embodiment. Referring to FIG. 5, a screen (a) illustrates a comparative example of a CCFL backlight operation; a screen (b) illustrates a comparative example of brightness control for regions using a LED backlight; a screen (c) illustrates a comparative example of a brightness and gradation control for regions using a LED backlight; and a screen (d) illustrates an example of a brightness and gradation control for regions using a LED backlight of the embodiment.

The screens (a) to (d) of FIG. 5 display an image of a mountain in a method of the brightness control for the regions (Local Dimming) using a top-type backlight. The screen (a) of FIG. 5 is constantly irradiated by the backlight using CCFL on the entire surface of the screen at a high brightness.

The brightness of an ordinary LED backlight is related to a predetermined arbitrary number of divisions of the screen which is subjected to a simple brightness control for regions. As illustrated in the screen (b) of FIG. 5, when bright backlights for an image of sky and dark backlights for an image of mountain are displayed and a brightness level of the backlights is excessively high, there may occur a brightness change around an edge of the image of the mountain to cause a strange visual effect.

As illustrated in the screen (c) of FIG. 5, when gradation of the brightness is given to each block using pulse width modulation (PWM), dither, or the like, the artificiality (strange visual effect) is less than it is for the screen (b). However, there still remains the strange visual effect because a gray portion exists in blocks corresponding to the edge of the image of the mountain.

Referring to the screen (d) of FIG. 5, the brightness control is carried out within one block in the method of the brightness control for regions according to the embodiment. Therefore, the strange visual effect is removed and the image becomes easier to see. With the embodiment, other portions of the backlight which does not relate to the display are not driven. Therefore, the power consumption can be effectively reduced while providing the optimum image quality.

FIG. 6 illustrates an example operational condition of the LED backlight of the embodiment. Referring to FIG. 6, an Aa block, a Bb block, and a Cc block correspond to the regions Aa, Bb, and Cc of the screen (d) of FIG. 5 (Dimming Block). Referring to FIG. 6, control levels of the backlight, the LPF signal, and the HPF signal are illustrated. The signal waveforms correspond to the lines (I), (D), and (B).

Referring to the screen (d) of FIG. 5 and FIG. 6, the Aa block has high brightness and the Cc block has low brightness. Therefore, the Aa block is controlled to be simply turned on the corresponding backlight region, and the Cc block is controlled to simply turned off the corresponding backlight region.

Therefore, the brightness control for the region corresponding to the Aa block is carried out by turning on the backlight to be maximum (100%) and the LPF and HPF are minimized or not used (0%). Meanwhile, the brightness control for the region corresponding to the Cc block is carried out by turning off or making the backlight to be a minimum (0%) and the LPF and HPF are minimized or not used (0%).

With the embodiment, the average brightness (APL) is acquired as one of the signal components for the Bb block, and a standard brightness of the block in its entirety is determined. Next, a boundary of the brightness change is acquired by the above LPF. The image signal is corrected to support the boundary and further to compensate a portion degraded by the low brightness correction with a high frequency component acquired from the HPF.

Referring to FIG. 6, the brightness of the backlight for the Bb block is 20%, and a lower range correcting signal supplied from the LPF and a higher range correcting signal supplied from the HPF are added based on the predetermined level in order to control the brightness for the regions.

Depending on the number of the divided regions of the backlight, the optimum levels of the backlight (e.g. brightness in percentage), the LPF 24 (e.g. application in percentage) and the HPF 22 (e.g. application in percentage) for each number of the divided regions may be determined in order to constantly realize a high image quality and a low power consumption. Thus, the liquid crystal displaying device 20 can be easily corrected to have the optimum levels of the backlight, the LPF 24 and the HPF 22 with respect to the number of the divided regions of the backlight.

As described, it is possible to simultaneously realize the efficient power consumption and optimum image quality.

Specifically, in improving the image quality of a liquid crystal display using a LED backlight, the image quality control of the signal system and the backlight system control are dynamically linked to thereby reduce the power consumption and obtain an image having high definition and high image quality.

For example, it is possible to obtain the optimum image control by associating signal components of image information such as an average brightness (APL) with signal information acquired by the highpass filter and the lowpass filter after dividing a backlight into arbitrary backlight blocks using an image quality improving measure related to liquid crystal displays which are used for a LCD-TV receivers or the like. Therefore, the optimum backlight control of the regional brightness type is realized.

By changing the property of the lowpass filter in conformity with the number of dividing the backlight from the input signal, a liquid crystal display controlling technique realizing a more efficient reduction of the power consumption and the optimum image quality is obtainable.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A liquid crystal displaying device having a liquid crystal displaying unit and a backlight unit for emitting a light into a back surface of the liquid crystal displaying unit, the liquid crystal displaying device comprising:

a signal processing unit configured to divide an input signal into a plurality of blocks in conformity with a predetermined number of dividing a screen of the backlight unit;

a high frequency component acquiring unit configured to acquire high frequency components for each of the plurality of blocks;

a signal component analyzing unit configured to analyze signal components of the input signal for each of the plurality of blocks;

a low frequency component acquiring unit configured to acquire low frequency components for each of the plurality of blocks;

a backlight driving signal generating unit configured to generate a backlight driving signal for the backlight unit based on signals acquired by the signal component analyzing unit and the low frequency component acquiring unit;

an inverter configured to invert the backlight driving signal acquired by the backlight driving signal generating unit; and a synthesizing unit configured to acquire a synthesized signal displayed by the liquid crystal displaying unit based on the input signal, the high frequency components acquired by the high frequency component acquiring unit, and an inverted driving signal acquired by the inverter, wherein the inverter includes a second level adjusting unit configured to adjust an inverting level of the backlight driving signal.

2. The liquid crystal displaying device according to claim 1, wherein the low frequency component acquiring unit includes a first level adjusting unit configured to adjust an acquired frequency level.

3. The liquid crystal displaying device according to claim 1, wherein the signal component analyzing unit detects the signal components of the input signal on the screen in its entirety, and the backlight driving signal generating unit generates the backlight driving signal of the backlight unit using a control signal acquired by synthesizing a reference voltage corresponding to the signal component detected by the signal component analyzing unit with the low frequency components acquired by the low frequency component acquiring unit.

4. A liquid crystal displaying device having a liquid crystal displaying unit and a backlight unit for emitting a light into a back surface of the liquid crystal displaying unit, the liquid crystal displaying device comprising:

a signal processing unit configured to divide an input signal into a plurality of blocks in conformity with a predetermined number of dividing a screen of the backlight unit;

a high frequency component acquiring unit configured to acquire high frequency components for each of the plurality of blocks;

a signal component analyzing unit configured to analyze signal components of the input signal for each of the plurality of blocks;

a low frequency component acquiring unit configured to acquire low frequency components for each of the plurality of blocks;

a backlight driving signal generating unit configured to generate a backlight driving signal for the backlight unit based on signals acquired by the signal component analyzing unit and the low frequency component acquiring unit;

an inverter configured to invert the backlight driving signal acquired by the backlight driving signal generating unit; and a synthesizing unit configured to acquire a synthesized signal displayed by the liquid crystal displaying unit based on the input signal, the high frequency components acquired by the high frequency component acquiring unit, and an inverted driving signal acquired by the inverter, wherein the synthesizing unit synthesizes the inverted driving signal with the high frequency components to provide a correction signal for the backlight, wherein the synthesizing unit causes the correction signal to be controlled to match levels of the correction signal and the driving signal in association with the correction signal and the driving signal, and to be superposed on the input signal.

5. A liquid crystal displaying method used in a liquid crystal displaying device having a liquid crystal displaying unit and a backlight unit for emitting a light into a back surface of the liquid crystal displaying unit, the liquid crystal displaying method comprising:

dividing an input signal into a plurality of blocks in conformity with a predetermined number of dividing a screen of the backlight unit;

acquiring high frequency components for each of the plurality of blocks;

analyzing signal components of the input signal for each of the plurality of blocks;

acquiring low frequency components for each of the plurality of blocks;

generating a backlight driving signal for the backlight unit based on signals acquired by the analyzing the signal components and the acquiring the low frequency components;

inverting the backlight driving signal acquired by the generating the backlight driving signal; and acquiring a synthesized signal displayed by the liquid crystal displaying unit based on the input signal, the high frequency components acquired by the acquiring the high frequency components, and an inverted driving signal acquired by the inverting the backlight driving signal, wherein the inverting of the backlight driving signal includes adjusting a second level for adjusting an inverting level of the backlight driving signal.

6. The liquid crystal displaying method according to claim 5, wherein the acquiring of low frequency components includes adjusting a first level for adjusting an acquired frequency level.

7. The liquid crystal displaying method according to claim 5, wherein the analyzing of the signal components includes detecting the signal components of the input signal on the screen in its entirety, and the generating of the backlight driving signal includes generating the backlight driving signal of the backlight unit using a control signal acquired by synthesizing a reference voltage corresponding to the signal component detected by the analyzing the signal component with the low frequency components acquired by the acquiring the low frequency components.

8. A liquid crystal displaying method used in a liquid crystal displaying device having a liquid crystal displaying unit and a backlight unit for emitting a light into a back surface of the liquid crystal displaying unit, the liquid crystal displaying method comprising:

dividing an input signal into a plurality of blocks in conformity with a predetermined number of dividing a screen of the backlight unit;

acquiring high frequency components for each of the plurality of blocks;

analyzing signal components of the input signal for each of the plurality of blocks;

acquiring low frequency components for each of the plurality of blocks;

generating a backlight driving signal for the backlight unit based on signals acquired by the analyzing the signal components and the acquiring the low frequency components;

inverting the backlight driving signal acquired by the generating the backlight driving signal; and acquiring a synthesized signal displayed by the liquid crystal displaying unit based on the input signal, the high frequency components acquired by the acquiring the high frequency components, and an inverted driving signal acquired by the inverting the backlight driving signal, wherein the acquiring of the synthesized signal synthesizes the inverted driving signal with the high frequency components to provide a correction signal for the backlight wherein the acquiring of the synthesized signal includes causing the correction signal to be associated with the backlight driving signal, controlled to match levels of the correction signal and the driving signal, and superposed on the input signal.

* * * * *